US011958644B2

(12) United States Patent
Dünki

(10) Patent No.: US 11,958,644 B2
(45) Date of Patent: Apr. 16, 2024

(54) SEAMING SHAFT DEVICE FOR A SEALER

(71) Applicant: Ferrum Packaging AG, Schafisheim (CH)

(72) Inventor: Jürg Dünki, Dietikon (DE)

(73) Assignee: FERRUM PACKAGING AG, Schafisheim (CH)

( * ) Notice: Subject to any disclaimer, the term of this patent is extended or adjusted under 35 U.S.C. 154(b) by 0 days.

(21) Appl. No.: 17/790,035

(22) PCT Filed: Jan. 30, 2020

(86) PCT No.: PCT/EP2020/052249
§ 371 (c)(1),
(2) Date: Jun. 29, 2022

(87) PCT Pub. No.: WO2021/151489
PCT Pub. Date: Aug. 5, 2021

(65) Prior Publication Data
US 2023/0059672 A1 Feb. 23, 2023

(51) Int. Cl.
*B65B 31/04* (2006.01)
*B21D 51/26* (2006.01)

(52) U.S. Cl.
CPC ..... *B65B 31/046* (2013.01); *B21D 51/2661* (2013.01)

(58) Field of Classification Search
CPC .... B65B 31/046; B21D 51/2661; B21D 37/04
See application file for complete search history.

(56) References Cited

U.S. PATENT DOCUMENTS 5,533,853 A * 7/1996 Wu ..... B21D 51/2653 413/31
5,839,869 A * 11/1998 Moran ..... B21D 51/32 413/31
9,545,656 B2 * 1/2017 Aldred ..... B21D 51/32
2004/0062625 A1 * 4/2004 Egerton ..... B21D 51/32 413/27
2011/0033265 A1 * 2/2011 Gogola ..... B21D 45/06 413/31

(Continued)

OTHER PUBLICATIONS

International Search Report dated Nov. 2, 2020 in corresponding European Application No. PCT/EP2020/052249.

*Primary Examiner* — Andrew M Tecco
*Assistant Examiner* — Nicholas E Igbokwe
(74) *Attorney, Agent, or Firm* — GLOBAL IP COUNSELORS, LLP

(57) ABSTRACT

A seaming shaft device for a sealer includes a seaming shaft, a seaming device detachable from the seaming shaft, and a fastening mechanism for fastening the seaming device to the seaming shaft. The fastening mechanism includes a lock and a fastener which can be arranged between the lock and the seaming device. The lock and the seaming device can be moved relative to each other along the seaming axis so that the seaming device can be brought from a locked state to an unlocked state, and the fastener in the locked stat is clamped between the seaming device and the lock such that the seaming device is fixed to the seaming shaft. The fastener can be unclamped by bringing the seaming device from the locked state to the unlocked state so that the seaming device is detachable from the seaming shaft.

15 Claims, 3 Drawing Sheets

(56) References Cited

U.S. PATENT DOCUMENTS

| | | | | |
|---|---|---|---|---|
| 2014/0321949 | A1* | 10/2014 | Mejia-Quinchia | B21D 51/2653 413/4 |
| 2016/0236357 | A1* | 8/2016 | Kalb | B23B 31/1071 |
| 2019/0240718 | A1* | 8/2019 | Bratsch | B21D 51/2661 |

* cited by examiner

SEAMING SHAFT DEVICE FOR A SEALER

CROSS-REFERENCE TO RELATED APPLICATION

This application is a U.S. National Stage application of International Application No. PCT/EP2020/052249, filed Jan. 20, 2020, the contents of which is hereby incorporated by reference.

BACKGROUND

Field of the Invention

This disclosure relates to a seaming shaft device for a sealer. This disclosure further relates to a sealer with a seaming shaft device and to a method for exchanging a seaming device.

Background Information

When filling beverage cans or food cans, the cans pass through a can sealer after being filled with the beverage or food, wherein the filled can bodies enter via a feed path and can lids enter via a further feed path. The can sealer usually has several similar stations arranged in a carousel shape, in each of which a can is sealed with a can lid, The can lids are guided onto the can bodies and held on the can body with a holding plate of a seaming head. This holding also serves to fix the cans against breaking out of the circular path through which the cans pass in the can sealer due to centrifugal force. The can bodies are seamed with the can lid over a seaming roller at the edges and thus sealed in the can sealer. Normally, the can with the can lid is additionally rotated around its own axis of symmetry by the seaming head. For rotation, the seaming rollers and seaming heads are arranged on a respective seaming shaft.

In DE 749636 and DE 4234115 A1, a conventional can sealer is described. The can sealer comprises a clamping device for receiving a can to be sealed. In the operating state, the can to be sealed is introduced into the clamping device and secured by it in axial and radial direction. A can lid is also introduced centered over the can opening of the can to be sealed. The can has a circumferential can flange in the area of the can opening and the can lid has a circumferential can lid flange. For sealing the can opening by the can lid, the can sealer additionally comprises two seaming rollers, each mounted rotatably about an axis, which press the can flange and the can lid flange together by means of a force acting substantially radially, the pressing being effected by a continuous rolling in the circumferential direction along the circumference of the can opening.

A further conventional can sealer is disclosed in the GB 2093899 A. The can sealer comprises a clamping device for receiving the can to be sealed and a seaming roller. In the operating state, the can to be sealed is introduced into the clamping device and secured by it in axial and radial direction. A can lid is also introduced centered over the can opening of the can to be sealed. The can has a circumferential can flange in the area of the can opening of the can body and the can lid has a circumferential can lid flange.

Different container shapes can be sealed with a single sealer if the seaming means or device (seaming roller and seaming head) are adapted to the corresponding container dimensions. For this purpose, the seaming means must be detached from the sealer and reattached to the sealer.

SUMMARY

It has been determined that a major disadvantage of the devices known from the state of the art is that changing the seaming means is time-consuming and complicated.

It is therefore an object of the present disclosure to provide a seaming shaft device for a sealer which avoids the adverse effects known from the state of the art. In particular, a seaming shaft device and a sealer are to be provided, which will significantly reduce standstill times due to tool changes.

The object is met by a seaming shaft device according to embodiments of this disclosure, by a sealer comprising the seaming shaft device according to this disclosure and by the method according to this disclosure for exchanging a seaming means or device.

According to this disclosure, a seaming shaft device for a sealer comprising a seaming shaft rotatable about a seaming axis, a seaming means (or device) detachably arranged at one end of the seaming shaft and a fastening mechanism for fastening the seaming means to the seaming shaft is proposed. The fastening mechanism comprises a locking element and a fastening element which can be arranged between the locking element and the seaming means.

The seaming shaft device according to the disclosure is characterized in that the locking element and the seaming means can be moved relative to each other along the seaming axis in such a way that the seaming means can be brought from a locking state to an unlocking state, and the fastening element in the locking state is clamped between the seaming means and the locking element in such a way that the seaming means is fixed to the seaming shaft (in particular is axially fixed with respect to the seaming axis, i.e. is arranged and axially secured on the seaming shaft), wherein the fastening element can be unclamped by bringing the seaming means from the locking state to the unlocking state so that the seaming means is detachably arranged at the end of the seaming shaft.

The seaming axis is the axis around which the seaming means rotates in the operating state when sealing a container. The seaming means can be a seaming roller, which is guided to a seam of the container in the operating state to seal the container by seaming. In addition, the seaming means can also be a seaming head which clamps and rotates the container to rotate the container (around the seaming axis).

A radial direction runs orthogonal to the seaming axis, in which radial direction clamping forces in the locking state mainly act by the fastening element between the seaming means and the locking element for fastening the seaming means to the seaming shaft.

According to the disclosure, a method for exchanging a seaming means in a seaming device according to the invention is further proposed. The locking element and the seaming means are moved relative to each other along the seaming axis so that the seaming means is brought from a locking state to an unlocking state, whereby the fastening element is unclamped. If the fastening element is unclamped, there are no longer any clamping forces in such a way that the seaming means can simply be detached from the end of the seaming shaft and can be exchanged/replaced by another seaming means.

Due to the relative movement of the locking element and the seaming means to each other, a distance between the locking element and the seaming means is preferably increased in such a way that no sufficient clamping forces are exerted by the fastening element between the locking element and the seaming means any longer, whereby the seaming means is brought into the unlocking state. As an alternative, an orientation of the fastening element could also be changed by the relative movement in such a way that no sufficient clamping forces are exerted between the locking element and the seaming means any longer.

In a preferred embodiment the relative movement (the relative movability) of the locking element and the seaming means along the seaming axis takes place relative to each another, in that the locking element can be moved along the seaming axis (and the seaming means is fixed relative to the seaming shaft until it is transferred to the unlocking state), so that, the seaming means can be brought from the locking state to the unlocking state by the movement of the locking element Mong the seaming axis. Here, the locking element can be moved along the seaming axis via a corresponding mechanism, for example triggered by a button/switch. For this purpose, the mechanism exerts an axial force (in the direction of the seaming axis) on the locking element. The axial force can, for example, be exerted by a, pneumatic, hydraulic or mechanical mechanism such as a spring.

Within the framework of the disclosure, the fact that the seaming means is detachably arranged at the end of the seaming shaft can be understood in such a way that the seaming means is fixed to the seaming shaft for the operating state (closing a container/seaming a can) via the fastening mechanism and can be removed from the seaming shaft for replacement by releasing the fastening mechanism (bringing/transferring from the locking state to the unlocking state).

In a one embodiment, the locking element is designed as a cone. The cone preferably is (comprises) a straight circular truncated cone, whith is arranged with its cone axis along, in particular in, the seaming axis. The cone axis is the axis which runs through the centers of the circular surfaces of the truncated cone. This means that the truncated cone has a first circular surface and a second circular surface. A first radius of the first circular surface is smaller than a second radius of the second circular surface, When bringing from the locking state to the unlocking state, the truncated cone is moved along the seaming axis in such a way that the first circular surface is moved in the direction of the fastening element. In doing so, the distance between the cone and the seaming means is increased by the movement from the locking state to the unlocking state in such a way that the fastening element is unclamped.

The first radius can be 0.1 times to 0.8 times, in particular 0.2 times to 0.6 times as large as the second radius.

In practice, the seaming means can be a groove, in particular a circumferential groove, in which the fastening element is arranged in the locking state. Due to this groove, the seaming means is additionally stabilized in the axial direction in the locking state.

In another embodiment, the fastening mechanism can comprise a spring mechanism with a compression spring. The spring mechanism can be arranged on the locking element in such a way that the locking element can be moved from the locking state to the unlocking state by an expansion of the compression spring. Particularly preferred, the compression spring can act on a previously described cone/truncated cone.

In practice, the fastening mechanism can comprise a plurality of fastening elements. In addition, the fastening element can be designed as a spere, an ellipsoid or a cuboid. in a further embodiment, a jacket of the cone/truncated cone could be straight or even curved. If the jacket is curved, this can preferably be combined with the sphere/ellipsoid as the fastening element, as this allows a fluid movement (easier movement) of the fastening element when transferring from the locking state to the unlocking state.

The seaming shaft device can comprise a sleeve arranged between the locking element and the seaming means, the sleeve comprising a recess, in which sleeve the fastening element is arranged in the locking state.

In another embodiment, the seaming shaft device can comprise an ejection element arranged in the seaming shaft. In this respect, the seaming means is the seaming head which fixes the container, wherein the ejection element is arranged movably along the seaming axis in such a way that a container can be ejected in the operating state.

According to the disclosure, a sealer for sealing a container is further proposed, the sealer comprising a sealing shaft device according to the invention. Preferably, the sealer is designed as a can sealer.

The container can be a can with a can lid, which are seamed together by the can sealer.

For sealing the can, the can sealer preferably comprises one or more seaming rollers (as known from the state of the art) and a seaming shaft device with seaming head as seaming means. In the operating state, the seaming rollers with their respective seaming profile are brought into contact with a can lid flange of the can lid and a can flange of the can. By rotating the can, the seaming roller is then rotated in the circumferential direction of the can, whereby the can flange is seamed to the can lid flange. To rotate the can, the can is preferably clamped between the seaming head and a support, whereby the seaming head is rotated around the seaming axis with the seaming shaft.

Within the framework of the invention, the can can be understood to be a rotationally symmetrical container which is sealed by means of the can sealer and the associated seaming roller. A can may preferably comprise a metal, in particular aluminum or steel.

In principle, the sealer according to the disclosure can be analogous to the can sealers already known from the state of the art but differs in the seaming shaft device. This has the advantage that the known can sealers/sealers can be modified with the seaming shaft device according to the invention in order to avoid the disadvantages of the state of the art in this way.

In practice, as in the state of the art, the can sealer comprises a clamping device including a seaming head and support with whiCh the can is fixed in axial and radial direction for sealing and can be rotated in the circumferential direction.

In principle, the sealer can comprise at least two seaming rollers, preferably with different seaming profiles, so that cans can be sealed according to a double seaming principle in which the cans are generally sealed in two stages. One seaming roller is responsible for one step. The first seaming roller makes a preliminary seam, while the second seaming roller completely seals the can/container.

BRIEF DESCRIPTION OF THE DRAWINGS

The invention will be explained in more detail hereinafter with reference to the drawings.

DETAILED DESCRIPTION

Figure 1:
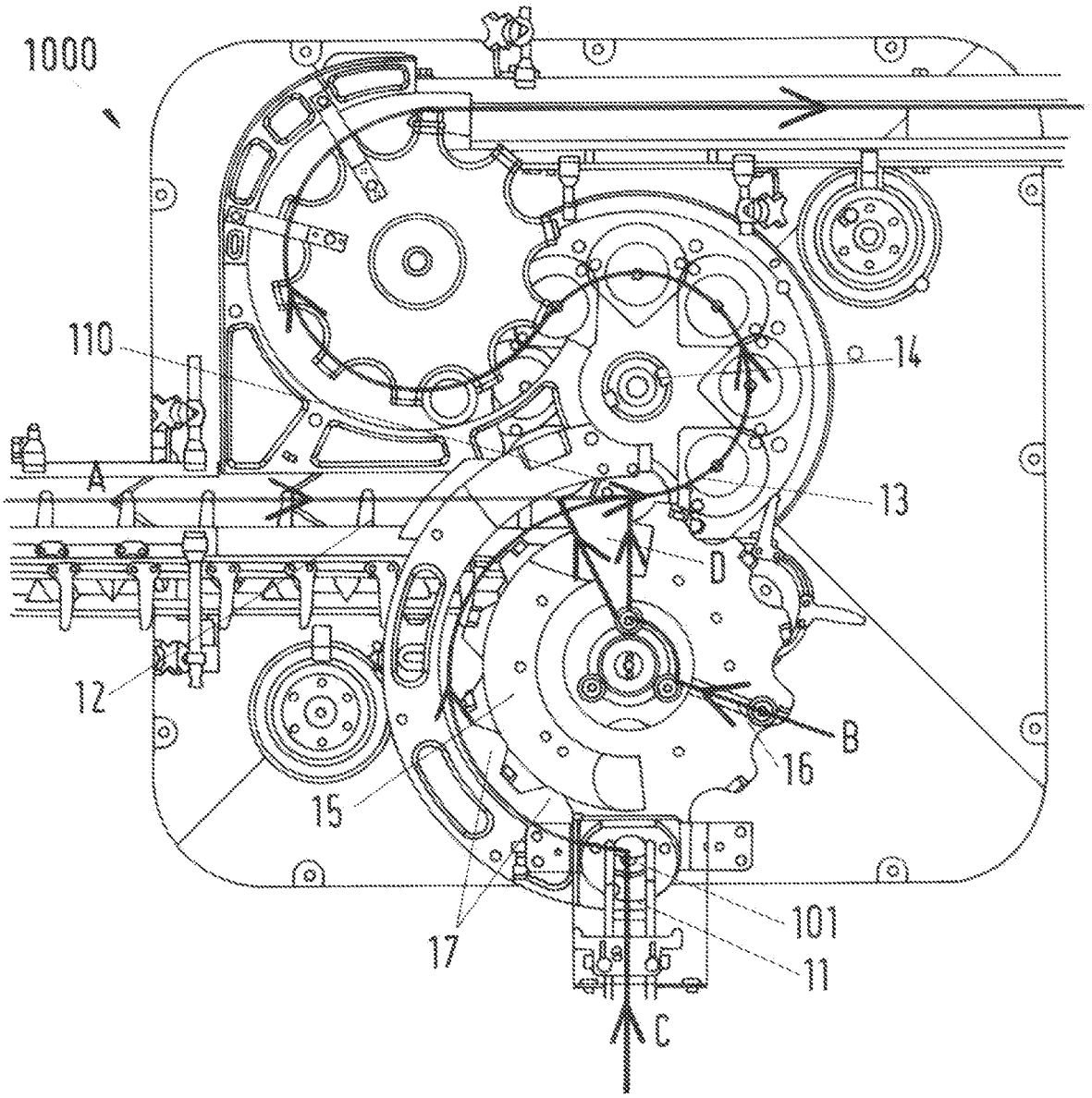
FIG. 1 illustrates a plan view of a sealer according to an embodiment of the invention.

FIG. 1 shows a plan view of a sealer arrangement 1000 according to the disclosure.

The sealer arrangement 1000 for sealing a container 100 comprises a lid feeding device 11 for feeding a lid 101 to the container 100, a gassing rotor 15 for supplying gas to the container 100 and a sealer 14 for sealing the container 100 with the lid 101.

In the represented embodiment, the sealer 14 is preferably designed as a can sealer 14. Here, the container 100 is a can 100 which is seamed in the can sealer 14.

In the operating state, the lid 101 is introduced along the arrow C by the lid feeding device 11 into the sealer arrangement 1000. In doing so, the lids 101 are arranged on the gassing rotor. The lids 101 are transported further by rotating the gassing rotor 15. Then, the containers 100 are introduced by the container feeder 12 into the container receptacles 17 of the gassing rotor 15. There, the container 100 is gassed in area D with a gas such as carbon dioxide or nitrogen and is combined with the lid 101.

The gassing is carried out along arrow B with the gas supply 16. After gassing, the container 100 with the lid 101 is passed by the container discharge 13 from the gassing rotor 15 to the sealer 14 where it is sealed.

Figure 2:
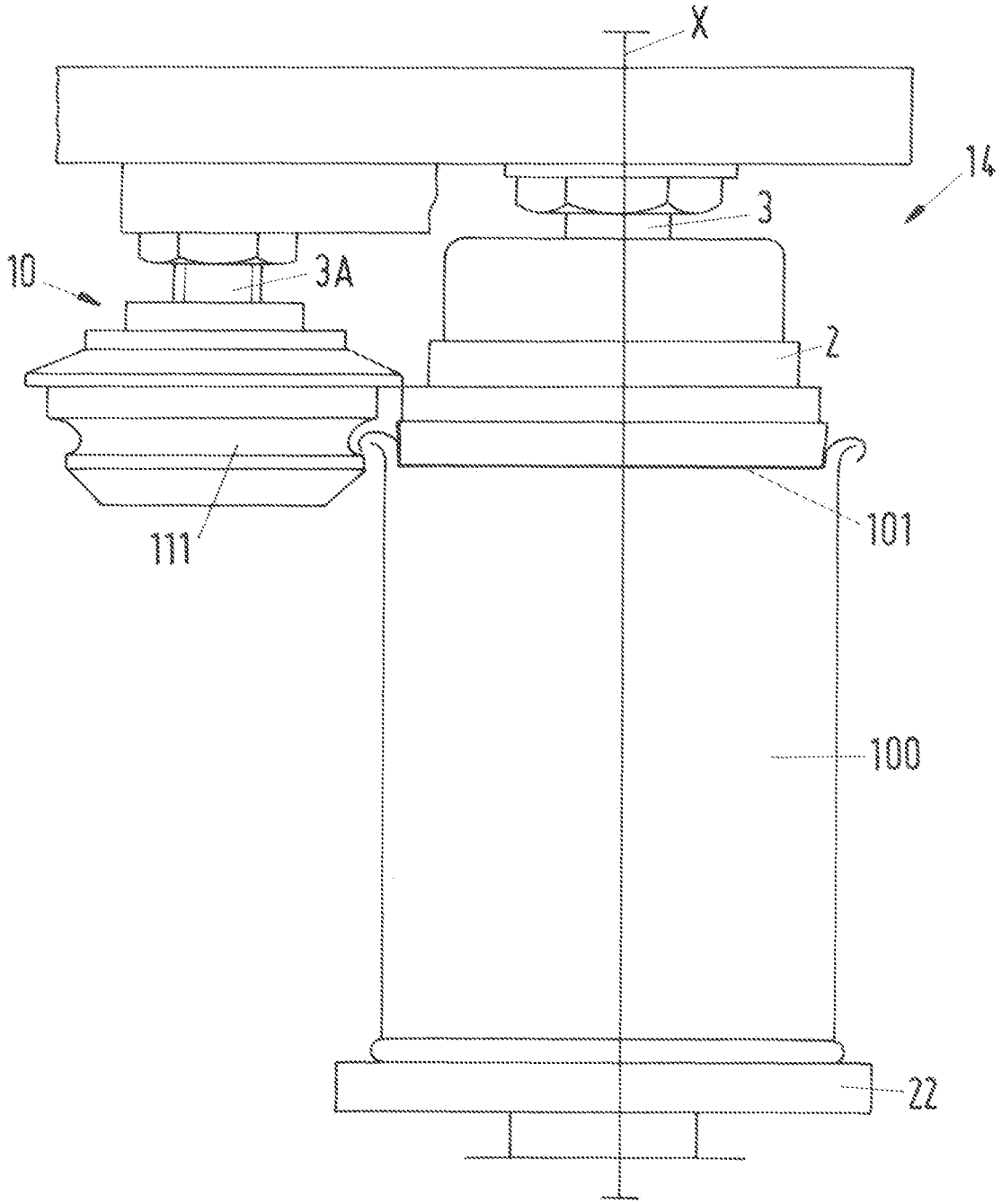
FIG. 2 illustrates a side view of a can sealer.

FIG. 2 shows a side view of a can sealer 14 according to an embodiment of the invention with a can 100 to be sealed and a can lid 101.

According to FIG. 2, the can sealer 14 comprises a clamping device comprising a can support 22 and a seaming head 2, and a seaming roller 10 with a seaming roller profile 111 rotatably mounted about the seaming shaft 3'. The can lid 101 is arranged centered over the opening of the can 100. The can 100 has a circumferential can flange in the area of the can opening and the can lid 101 has a circumferential can lid flange.

During the sealing process, the seaming roller 10 is brought into contact with the can flange and the can lid flange via the seaming roller profile 111. Here, the can flange and the can lid flange are pressed together via the seaming roller 10 by means of a force acting substantially radially. The pressing is effected by a continuous roiling of the seaming roller 10 in the circumferential direction along the circumference of the can opening, A double seam is preferably created by seaming the can 100 with the can lid 101.

For seaming, the can 100 is rotated by the clamping device by rotating the seaming head 2 around the seaming axis X with the seaming shaft 3.

Figure 3:
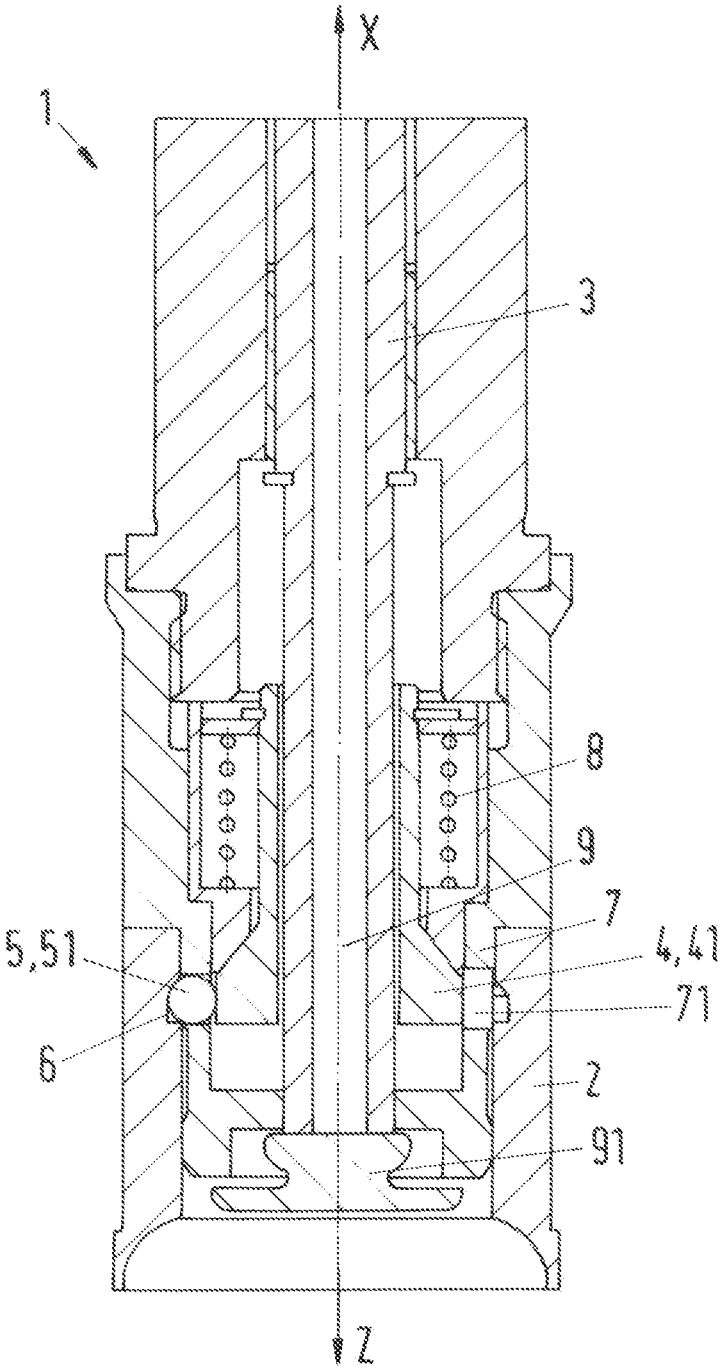
FIG. 3 illustrates a schematic view of a seaming shaft device according to an embodiment of the invention.

FIG. 3 shows a schematic view of a seaming shaft device 1 according to an embodiment of the invention.

The seaming shaft device 1 comprises the seaming shaft 3, which can be rotated around the seaming axis X, The seaming head 2 is detachably arranged as a seaming means or device at one end of the seaming shaft 3 and fastened to the seaming shaft 3 with a fastening mechanism for fastening the seaming head 2.

The fastening mechanism comprises a locking element 4 (lock) and a fastening element (fastener) 5, which is arranged between the locking element 4 and the seaming head 2.

The locking element 4 and the seaming head 2 can be moved relative to each other along the seaming axis X in such a way that the seaming head 2 can be brought from a locked state to an unlocked state, and the fastening element 5 in the locked state is clamped between the seaming head 2 and the locking element 4 in such a way that the seaming head 2 is axially fixed to the seaming shaft 3. The fastening element 5 can be unclamped by bringing the seaming head 2 from the locked state to the unlocked state so that the seaming head 2 can be detached from the end of the seaming shaft 3. In addition, the seaming head can be secured in a torque-proof manner on the seaming shaft by a pin arranged between the seaming head and the seaming shaft (not shown here).

The locking element 4 is designed as a cone 41, so that a distance between the cone 41 and the seaming head 2 can be increased by the movement from the locking state to the unlocked state in such a way that the fastening element 5 can be unclamped.

The cone 41 comprises a straight circular truncated cone (section), which is arranged with its cone axis along the seaming axis X. The cone axis is the axis which runs through the centers of the circular surfaces of the truncated cone. The truncated cone thus has a first circular surface and a second circular surface. A first radius of the first circular surface is smaller than a second radius of the second circular surffice.

When bringing from the locked state to the unlocked state, the cone 41 is moved along the seaming axis X in the direction of the arrow Z and the truncated cone with the first radius is brought to an axial height (point along the seaming axis X) with the fastening element 5. In doing so, a distance between the cone 41 and the seaming head 2 is increased in such a way that the fastening element 5 is unclamped.

The seaming shaft device 1 according to FIG. 3 is in the locking position. Here, the fastening element 5 is a sphere 51 and partly arranged in a circumferential groove 6 of the seaming head. Preferably, the fastening mechanism comprises a plurality of spheres 51.

The seaming shaft device 1 further comprises a spring mechanism 8 with a compression spring. The spring mechanism 8 is arranged on the cone 41 in such a way that it can displace the cone 41 by an expansion of the compression spring in the direction of the arrow Z. In doing so, the seaming head 2 is brought from the locking state to the unlocking state. For this purpose, the spring mechanism 8 can be triggered by means of a button.

Furthermore, the seaming shaft device 1 according to FIG. 3 comprises an ejection element 9 arranged in the seaming shaft 3. The ejection element 9 extends to the seaming head 2, where it ends with an ejector pad 91. The ejection element 9 is arranged movably along the seaming axis X, so that a container can be ejected by moving in the direction of the arrow Z in the operating state.

In addition, the seaming shaft device 1 comprises a sleeve 7 arranged between the cone 41 and the seaming head 2, the sleeve 7 comprising a recess 71 in which the sphere 51 is arranged in the locking state shown. If the cone 41 is moved along the seaming axis X in the direction of the arrow Z, the sphere 51 is unclamped as described above and can escape from the groove 6 of the seaming head 2 and the recess 71, whereby the seaming head 2 is brought to the unlocking state and can be detached from the end of the seaming shaft 3. Subsequently, a new/different seaming head can be attached.

The invention claimed is:

1. A seaming shaft device for a sealer, comprising:

a seaming shaft rotatable about a seaming axis;

a seaming device detachably arranged at one end of the seaming shaft; and a fastening mechanism configured to fasten the seaming device to the seaming shaft, the fastening mechanism comprising a lock and a fastener configured to be arranged between the lock and the seaming device, the lock and the seaming device configured to be moved relative to each other along the seaming axis such that the seaming device is capable of being brought from a locked state to an unlocked state, and the fastener in the locked state is clamped between the seaming device and the lock such that the seaming device is fixed to the seaming shaft, the fastener configured to be unclamped by bringing the seaming device from the locked state to the unlocked state so that the seaming device is detachably arranged at the end of the seaming shaft, and the fastening mechanism comprising a spring mechanism with a compression spring, and the spring mechanism arranged on the lock such that the lock is capable of being moved from the locked state to the unlocked state by expansion of the compression spring.

2. The seaming shaft device according to claim 1, wherein the lock is configured to be moved along the seaming axis so that the seaming device is capable of being brought from the locked state to the unlocked state.

3. The seaming shaft device according to claim 1, wherein the seaming device includes a seaming roller.

4. The seaming shaft device according to claim 1, wherein the seaming device is a seaming head.

5. The seaming shaft device according to claim 1, wherein the lock has a partial conical shape so that a distance between the lock and the seaming device is configured to be increased by movement from the locked state to the unlocked state such that the fastener is capable of being unclamped.

6. The seaming shaft device according to claim 1, wherein the seaming device comprises a groove, in which the fastener is arranged in the locked state.

7. The seaming shaft device according to claim 6, wherein the groove is a circumferential groove.

8. The seaming shaft device according to claim 1, wherein the fastener is one of a plurality of fasteners.

9. The seaming shaft device according to claim 1, further comprising a sleeve arranged between the lock and the seaming device, the sleeve comprising a recess, the fastener being arranged in the recess in the locked state.

10. The seaming shaft device according to claim 1, wherein the fastener is a sphere, an ellipsoid or a cuboid.

11. The seaming shaft device according to claim 1, further comprising an ejection element arranged on the seaming shaft, the ejection element being movable along the seaming axis such that a container is capable of being ejected in an operating state.

12. A sealer comprising:

the seaming shaft device according to claim 1.

13. The sealer according to claim 12 designed as a can sealer.

14. A method for exchanging a seaming device in a seaming shaft device, the method comprising:

providing the seaming shaft device according to claim 1;

moving the lock and the seaming device relative to each other along the seaming axis so that the seaming device is brought from the locked state to the unlocked state, in which the fastener is unclamped;

detaching the seaming device from the end of the seaming shaft.

15. The method according to claim 14, wherein the lock is moved along the seaming axis so that the seaming device is brought from the locked state to the unlocked state.

* * * * *